US005176268A

United States Patent [19]

Manley

[11] Patent Number: 5,176,268

[45] Date of Patent: Jan. 5, 1993

[54] RAILROAD CAR DRAFT SYSTEM ASSEMBLY HAVING IMPROVED WEAR LIFE

[75] Inventor: R. Michael Manley, Richmond, Tex.

[73] Assignee: Houston Industries Incorporated, Houston, Tex.

[21] Appl. No.: 713,695

[22] Filed: Jun. 11, 1991

[51] Int. Cl.[5] ..... B61G 7/00

[52] U.S. Cl. ..... 213/56; 213/50

[58] Field of Search ..... 213/50, 56, 57, 40 R, 213/12, 20, 21, 61, 62 R, 64, 66, 67 R, 67 A, 69, 70, 71, 72

[56] References Cited

U.S. PATENT DOCUMENTS

| | | | |
|---|---|---|---|
| 1,192,497 | 7/1916 | Chiles | 213/69 |
| 1,562,094 | 11/1925 | Kadel et al. | 213/50 |
| 1,881,226 | 10/1932 | O'Connor | 213/61 |
| 1,908,541 | 5/1933 | Regan | 213/63 |
| 1,918,862 | 7/1933 | O'Connor | 213/50 |
| 1,947,936 | 1/1934 | Glascodine | 213/50 |
| 2,135,704 | 11/1938 | Firth | 213/50 |
| 2,386,476 | 10/1945 | Kinne et al. | 213/67 |
| 3,090,086 | 5/1963 | Fata | 403/381 |
| 3,559,818 | 2/1971 | Knippel et al. | 213/8 |
| 3,716,146 | 2/1973 | Altherr | 213/75 R |
| 4,019,298 | 4/1977 | Johnson | 403/331 |
| 4,022,329 | 5/1977 | Dilg | 213/67 R |
| 4,120,404 | 10/1978 | Chierici et al. | 213/61 |
| 4,311,765 | 1/1982 | Chung | 213/7 |
| 4,478,154 | 10/1984 | Holden et al. | 105/225 |
| 4,480,758 | 11/1984 | Hurt et al. | 213/84 |
| 4,531,648 | 7/1985 | Paton | 213/50 |
| 4,593,827 | 6/1986 | Altherr | 213/50 |
| 4,995,176 | 2/1991 | Briscoe et al. | 403/381 |
| 5,042,615 | 8/1991 | Anderson | 403/381 |

FOREIGN PATENT DOCUMENTS

| | | | |
|---|---|---|---|
| 1029368 | 5/1966 | United Kingdom | 213/50 |

OTHER PUBLICATIONS

Manual of Standards and Recommended Practices, Association of American Railroad, pp. B337, B154, B335, B153, B17, B36, B37 and B157, Aug. 1, 1988.

*Primary Examiner*—Douglas C. Butler
*Assistant Examiner*—Mark T. Le
*Attorney, Agent, or Firm*—Pravel, Gambrell, Hewitt, Kimball & Krieger

[57] ABSTRACT

A railroad car having an improved draft gear assembly including a center sill structure terminating at one end in a draft center sill section having a yoke mounted therewith. The yoke includes first and second yoke members extending longitudinally. An interlocking coupler member including a head portion and a shank portion is mounted with the yoke. A connector assembly holds the interlocking coupler member in position in the yoke. The interlocking coupler member includes a rear butt portion positioned internally of the connector assembly for engaging a follower block mounted substantially between the first and second yoke members. A resilient member is mounted between the follower block assembly and the end of the yoke. The follower block assembly includes a central section located between the yoke members and further includes first and second guide portions which are joined to a central follower block section and extend outwardly to hold the follower block in position in spite of the application of external forces. A yoke positioner assembly is mounted with the draft sill section to maintain the yoke in a substantially longitudinal position in spite of the application of stresses through the interlocking coupler member and yoke.

14 Claims, 2 Drawing Sheets

RAILROAD CAR DRAFT SYSTEM ASSEMBLY HAVING IMPROVED WEAR LIFE

FIELD OF THE INVENTION

This invention relates to draft gear assemblies for railroad cars and includes apparatus for maintaining the position of the follower block and additional apparatus for maintaining the longitudinal position of the yoke under the stresses of actual use.

BACKGROUND OF THE INVENTION

Typical railroad cars used for load carrying operations such as hopper cars include a center sill structure which has been used in the railroad industry for many decades. The center sill structure in a railroad car includes a generally longitudinal central beam which provides the principle structural support for the entire underframe of the hopper car and allows for the transmission of the forces of draft (pulling) and buff (pushing) through a series of hopper cars. The center sill sections of such railroad cars terminate at each end in draft center sill sections. Some types of gondola cars utilize draft center sill sections without the central or through member center sill.

In any car using a draft center sill, a yoke is mounted in the draft center sill section and includes a cast yoke member having upper and lower yoke members and an internal end portion in order to form a longitudinal pocket or recess. Such yokes are well known in the industry, and have been standardized by the American Association of Railroads (AAR). Also standardized by the AAR are couplers which are mounted partially within the yoke and extend outwardly from the railroad car to couple to another railroad car. Typically, these couplers include a coupling head and a shank portion. The shank portion is connected by a pin or key to the yoke, which pin extends through an end portion of the shank of the coupler to mount the coupler for pivotal movement with respect to the yoke. The portion of the shank positioned internally of the connecting pin is known as the rear butt portion of the coupler. It is known and recommended by the AAR that a follower block be mounted between the upper and lower yoke members internally of the coupler rear butt portion to engage the rear butt portion. The follower block is mounted in this longitudinal recess between the upper and lower yoke members and serves to confine any type of resilient or spring mechanism which is positioned between the internal end of the yoke member and the follower block. In this manner, in response to draft and buff forces, particularly buff forces, the forces exerted against the coupler which are transmitted through the connecting pin and rear butt section to the follower block are evenly transmitted to the resilient mechanism or spring and thereby cushioned.

One of the problems with known follower block is that such follower blocks are rather loosely mounted within this pocket or recess between the upper and lower yoke members, and are only confined by side members of the draft sill structure. This confinement has proved to be inadequate under certain stress conditions where, in response to extreme stresses or to repeated stresses, the follower block may be pushed out of position. If the follower block is pushed out of position, the efficiency of the shock absorbent or resilient means located in the yoke recess is substantially diminished.

This dislocation of follower blocks is a known problem which causes maintenance to railroad cars.

Another known problem relating to the draft gear assembly is that the yoke members themselves are pushed sideways or transversely from their longitudinal positions as a result of the same stresses applied to the coupler, which transmit through the connecting pin to the yoke. Transverse displacement of the yoke members, which are also only held in position by a part of the draft sill structure, can enhance dislocation of the follower block and can cause the yoke members to lose their longitudinal alignment which also reduces the efficiency of the cushioning mechanism located in the yoke member and can cause an entire structural deterioration of the yoke member itself due to wear of an out-of-position yoke member against the draft sill structure.

Insofar as known, these problems have not been adequately dealt with in prior draft gear assemblies. A review of certain known patents also shows that little effort has been made to solve these draft system assembly wear problems.

U.S. Pat. No. 1,947,936 of Glascodine discloses a central buffing and draft gear wherein liner plates are mounted against the side members of the center sill for purpose of absorbing lateral stress from the yoke. Such efforts to absorb the lateral stresses of the yoke member, as disclosed in the Glascodine patent, do not attempt to confine the position of the yoke member against the external forces of coupler movement. The Glascodine patent further discloses the use of front and rear follower plates which are mounted within the yoke member and extend outwardly to the side sill structure. Each of the follower plates include flange portions extending peripherally in order to provide enlarged bearing surfaces in contact with the side, liner plates which absorb shocks and prevent tendency of the follower plates to rock under stress. Thus, these peripheral flanges do not actually engage the yoke members themselves, but rather engage the side members of the side sill structure.

U.S. Pat. No. 3,599,818 of Knippel et al. discloses the use of projecting portions on a rear wall member which also engages a resilient mechanism within the center sill. The projecting portions in Knippel are for the purpose of confining a spring part of the resilient mechanism and mounting additional external absorbing elements, and do not engage or maintain the rear block in position with respect to a yoke.

Other patents generally disclosing follower blocks include U.S. Pat. No. 4,593,827 of Altherr which discloses a generally rectangular follower block which engages the rear butt portion of a draw bar and is held in position within a pocket casting. U.S. Pat. No. 2,386,476 of Kinne et al. also discloses a follower block mounted within the pocket of a casting. U.S. Pat. Nos. 4,531,648 of Paton; 3,716,146 of Altherr; and 4,480,758 of Hurt disclose various embodiments of follower blocks. U.S. Pat. No. 4,311,765 of Chung discloses a polyurethane shock absorbing unit to be used inside a draft gear as a primary shock absorbing medium within the gear.

In summary, there is no known solution for the problem of migration of the draft gear follower block and the wear problems associated with transverse or sideways movement of the yoke itself in response to the external stresses placed upon the coupling element. The result of these stresses is that the follower blocks lose position potentially causing undue wear. There is additional undue wear that can be caused by the yoke being moved out of position or being subjected to transverse agitation. The only known way to repair these problems is to take a railroad hopper car out of commission, replace the parts and/or building up through weld the effected wear areas, all of which is extremely time-consuming and expensive.

SUMMARY OF THE INVENTION

This invention relates to an improved draft gear assembly intended to have a longer life than draft gear assemblies by reducing wear and maintaining alignment within the structure of the draft gear assembly. The improved draft gear assembly of this invention includes a center sill structure terminating a one end in a draft center sill section having a yoke mounted therewith. An interlocking coupler member is mounted by a connector assembly to the yoke. A follower block assembly is mounted within the structure of a yoke behind the butt end portion of the interlocking coupler member for purposes of transmitting forces exerted against the coupler against a resilient or cushioning mechanism mounted within the yoke behind the follower block assembly. The follower block includes a central section mounted within the yoke and first and second extending guide portions joined to the central follower block section and extending outwardly of the yoke into engagement with a yoke for maintaining the position the follower block even under the stress of external forces. Additionally, the improved draft gear assembly may include yoke positioner assembly mounted onto the draft sill structure on opposite sides of the yoke for purposes of maintaining the longitudinal position of the yoke even under the influence of external forces applied through the coupler member. This Summary Of The Invention is not intended to set forth all of the patentable aspects of applicant's invention as described in detail in the following description of the preferred embodiment.

DESCRIPTION OF THE PREFERRED EMBODIMENT

Figure 1:
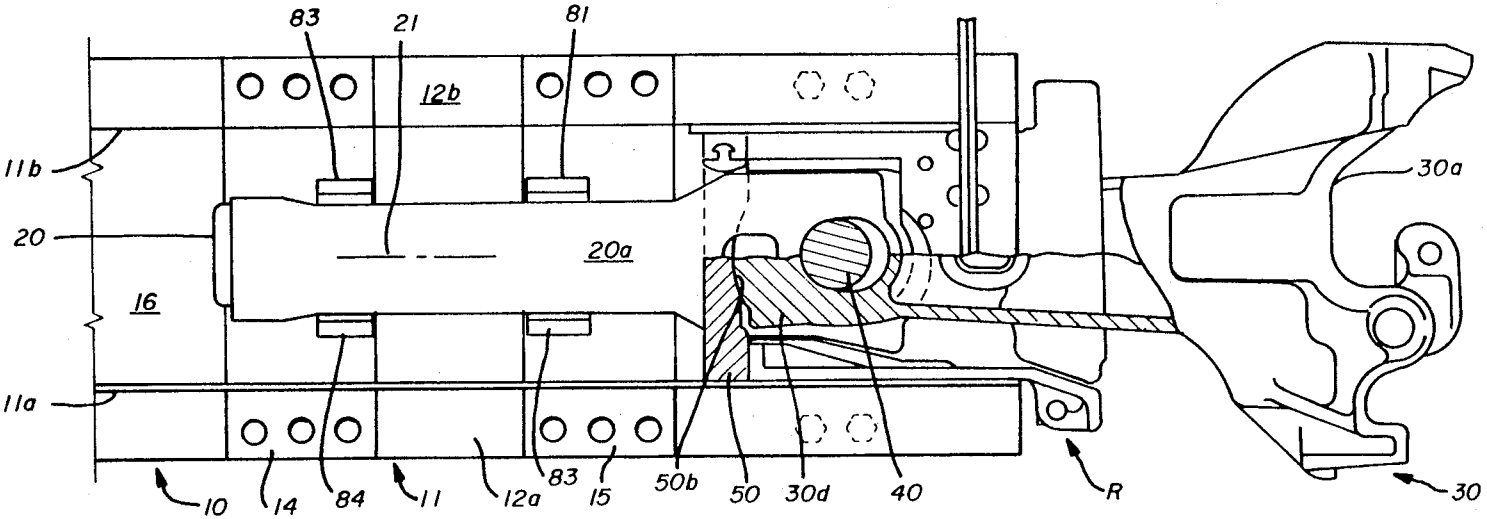
FIG. 1 is a top view partially in section of the improved draft gear assembly of this invention.

Referring to the drawings, the letter R is directed to the improved draft gear assembly for a railroad car of the preferred embodiment of this invention. Such a railroad car typically includes a center sill as is known in the American railroad industry. Such center sill structure is generally designated by the number 10 in FIG. 1. Such a center sill structure typically includes a central frame member which extends longitudinally the length of a railroad car and is provided for the purpose of being the central frame support for the railroad car. Further, such a center sill assembly as is known in the railroad industry provides for the transmission of draft (pulling) and buff (pushing) forces that are directed against the railroad car.

The center sill structure 10 includes a draft center sill section 11 which is particularly illustrated in FIG. 1. The draft center sill section 11 includes opposing side members 11*a* and 11*b* which terminate in bottom ledge members 12*a* and 12*b*. Mounted on ledge members 12*a* and 12*b* are the laterally extending yoke straps 14 and 15. The laterally extending yoke straps 14 and 15 are each rectangular plates which are spaced somewhat apart and are attached to the draft sill section ledges 12*a* and 12*b* by a series of bolts or rivets such as 14*a* and 15*a* (FIG. 2).

Figure 2:
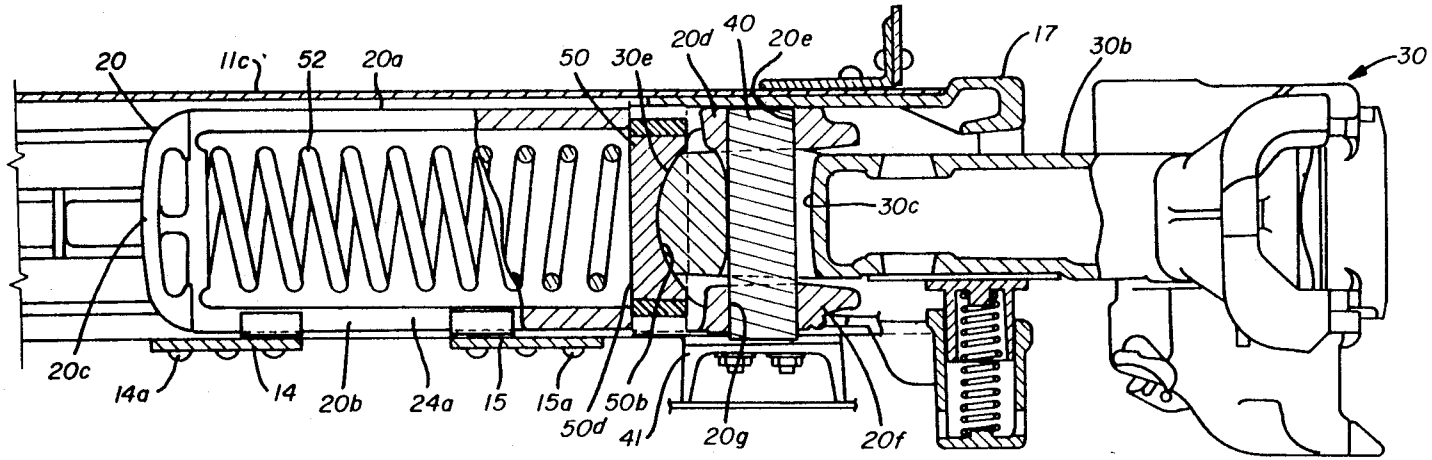
FIG. 2 is a side view partially in section of the improved draft gear assembly of FIG. 1.

Referring to FIG. 2, the draft center sill section 11 further includes a top plate member 11*c* which cooperates with the side sill members 11*a* and 11*b* and the bottom yoke straps 14 and 15 to form a generally rectangular compartment identified by the number 16. A casting known as a striking casting 17 is mounted on the bottom of the top draft center sill structure plate 11*c* and extends outwardly therefrom.

A yoke member generally designated by the number 20 is mounted within compartment 16 of draft center sill structure 11. The yoke member 20, which is viewed principally from the top, partly in section in FIG. 1, is viewed from the side and partly in section in FIG. 2 and in perspective in FIG. 3. The structure of illustrated yoke member 20 is well known in the railroad industry. Such yoke member is disclosed in the Association of American Railroads, Mechanical Division, Manual of Standards and Recommended Practices under the title "AAR Standard E/F and F Yokes," effective Feb. 1, 1973. The yoke 20 is formed by casting and includes an upper yoke member 20*a*, a lower yoke member 20*b* and an internal end member 20*c*. Each of the upper and lower yoke members 20*a* and 20*b* are generally rectangular in configuration and are mounted to extend longitudinally along the longitudinal axis 21 of the draft center sill 11 and thus of the railroad car itself. The upper yoke member 20*a* terminates at its outer end in an enlarged portion 20*d* having opening 20*e* machined therein. Similarly, the lower yoke member 20*b* terminates at its outer end in an enlarged portion 20*f* and also includes an opening 20*g* in alignment with opening 20*e*. Front side supporting portions 20*h* and 20*i* are cast with the entire yoke member 20 thereby providing substantial support to the yoke as a whole. A generally rectangular recess or pocket identified as 22 is formed by the yoke members 20*a* and 20*b*.

As previously described, the upper yoke member 20*a* is generally rectangular and thus includes parallel side edges 23*a* and 23*b* which extend outwardly by means of the outwardly tapered or flared edges 23*c* and 23*d* to form the enlarged portion 20*d* through straight side edges portions 23*e* and 23*f*. Similarly, the lower yoke member includes straight edge sections 24*a* and 24*b*.

A coupler member generally designated as 30 is also well known in the industry. The coupler member 30 is a standard coupler member of the Association of American Railroads and is identified in the Manual of Standards and Recommended Practices under the title "AAR Standard F Couplers," effective Jan. 1, 1977. The coupler member 30 includes a coupler head 30*a* adapted to engage a complementary coupler on another railroad car. The coupler head 30*a* is formed with a longitudinally extending, generally rectangularly tubular coupler shank or shaft 30*b*. The coupler shank 30*b* includes an opening 30*c* and an internal butt end portion 30*d* which terminates in a generally round. spherical end portion 30*e*.

A connector assembly includes a cylindrical pin 40 mounted in the opening 20*e* in the upper yoke member 20*a* and in the opening 20*g* in the lower yoke member 20*b*. The pin is held in position by the generally U-shaped connector pin support bracket 41 illustrated in FIG. 2, which is bolted to the bottom surface of the lower yoke member 20*b*. The pin 40 thus mounts the coupler member 30 in the pocket 22 of the yoke 20. The coupler head 30 is attached to a suitable coupler on the adjacent railroad car. Stresses are applied to the coupler member 30 during pushing, pulling and turning of the railroad cars around curves. These forces of tension, compression, and twisting or torque as applied to the coupler head 30*a* are transmitted through the coupler shank 30*b* to the pin 40. The pin 40 transmits the forces to the upper and lower yoke members 20*a* and 20*b*, which in turn transmit these forces to the mounting areas where the yoke members 20*a* and 20*b* are attached to the draft center sill structure 11. Transmission of these externally applied forces can place great stress upon the yoke members 20*a* and 20*b* and can cause wear between the yoke members 20*a* and 20*b* and the draft side sill structure 11 itself. These stresses can actually move the yoke members 20*a* and 20*b* out of the initial longitudinal alignment along the longitudinal axis 21.

Figure 4:
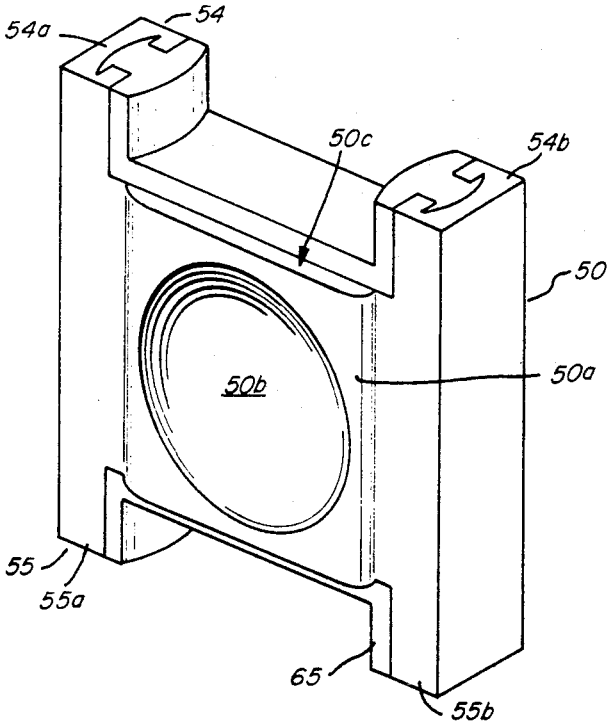
FIG. 4 is a perspective view of the follower block of this invention.

Forces are also transmitted through the coupler shank 30*b* to the butt end portion 30*e* of the coupler shank, particularly during buff and twisting or turning of the entire coupler. As discussed in the Background of the Invention, it is known to use a generally rectangular follower block. The follower block disclosed in this invention and generally identified by the number 50 is of a unique construction and configuration. The follower block 50 is shown in a perspective view in FIG. 4, in a top view partly in section in FIG. 1, and in a side view partly in section in FIG. 2. The follower block includes a generally central rectangular portion 50*a*. The front face of the rectangular portion has an approximately dome-shaped recessed area 50*b* formed therein for purposes of receiving the generally convex or dome-shaped end surface of the butt end section 30*e* of the coupler 30. This recessed area 50*b* in the central portion of the front face of the follower block is optional and may be circular as illustrated or of other configuration. The follower block 50 is positioned in the pocket of the upper and lower yoke members 20*a* and 20*b* to house a shock cushioning or resilient means generally designated as 52. In the embodiment illustrated, the resilient means 52 is a spring. It should be understood that any other type of cushioning element, series of elements, or cushioning mechanism as is known in the art may be utilized.

The follower block 50 is provided to transmit these external forces applied through butt and 30*e* to the spring or other cushioning member 52 to somewhat cushion the stresses that are applied through the coupling member such as during stopping or turning of the railroad car. The follower block 50 of this invention further includes first and second guide portions 54 and 55 formed integrally with the central follower block section 50*a* to extend upwardly and downwardly, respectively, outside of the yoke pocket 22 of maintaining the follower block 50 in position. The upper guide portion 54 includes guide posts or tab sections 54*a* and 54*b* which extend upwardly from each upper corner of the central follower block section 50*a*.

Figure 5:
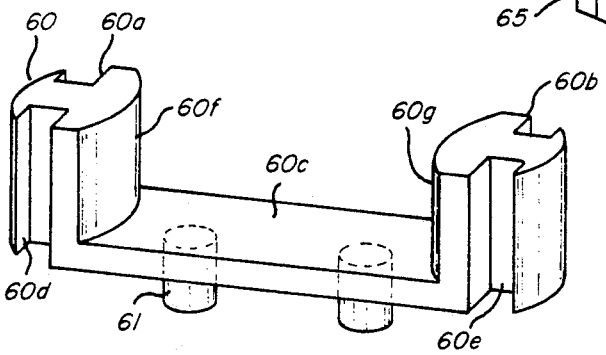
FIG. 5 is a perspective view of a wear insert for the follower block of this invention.

The guide posts 54*a* and 54*b* cooperate with a central flat rectangular intermediate face 50*c* to form a generally U-shaped configuration to fit under and on each side of the upper yoke member 20*a*. A generally U-shaped wear insert 60 as illustrated in FIG. 5 is mounted onto the guide posts 54*a* and 54*b* and extend therebetween on the upper surface 50*c* in order to provide a wear surface for engagement against the side edges 23*d* and 23*f* and 23*c* and 23*e*, respectively, on the upper yoke member 20*a*. It is anticipated that the follower block of this invention will be made of metal such as a steel. The purpose of the wear insert 60 is to avoid having the metal portions of the upwardly extending guide posts 54*a* and 54*b* actually be in contact with the side edges such as 23*d* and 23*f* of the upper yoke member, which could cause galling and other undue wear or damage to either the yoke member or the guide post. It is contemplated that the wear insert 60 will be made of a polyurethane or other suitably hard and rugged non-metallic material.

Referring to FIG. 5, the wear insert 60 is generally U-shaped and includes a first post member 60*a* and a second post members 60*b* which are joined by an intermediate generally rectangular connecting portion 60*c*. The post members 60*a* and 60*b* include groove portions 60*d* and 60*e*, respectively, which slide into complementary groove portions in the follower block guide posts 54*a* and 54*b*. Further connections, such as pins 61, are mounted in the intermediate insert section 60*c* and extend into corresponding holes in the top surface 50*c* of the follower block 50. The inside face of each guide post 60*a* and 60*b* is identified by the numbers 60*f* and 60*g*. The faces 60*f* and 60*g* are generally convex.

A similar wear insert 65 (FIG. 4) is mounted onto the guidepost 55*a* and 55*b* which are also formed integrally with the central portion 50*a* of the follower block but extend downwardly around the bottom yoke member 20*b*. The structure of the follower blocks 55*a* and 55*b* is identical of that of the follower blocks 54*a* and 54*b*, and thus includes internal grooves which mate with the grooves 60*d* and 60*e* of the wear insert posts follower tabs 60*a* and 60 *b*.

Figure 6:
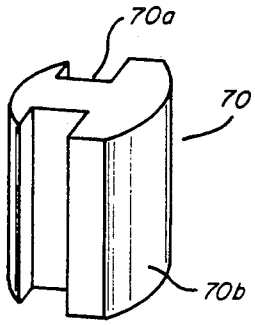
FIG. 6 is a perspective view of another version of the wear insert of FIG. 5.

As an alternative to the use of the generally U-shaped wear insert of FIG. 5, individual guide post inserts such as illustrated in FIG. 6 may be utilized. Referring to FIG. 6, the wear insert 70 is provided to be mounted on to a guide post such as guide post 54*a*. The insert 70 is of the same structure as the guide post portions such as 60*a* and 60*b* of the wear insert 60 of FIG. 5. Grooved portions 70*a* are provided to allow the wear insert member 70 to be inserted on to the guide post 54*a*. A generally convex wear surface 70*b* is provided to engage against the side edges of the upper and lower yoke members 20*a* and 20*b*.

In operation and use, the follower block 50 is placed in position with its front surface in engagement against the rear butt section 30*e* of the coupler shank 30*b*. The guide posts 54*a*, 54*b* extend upwardly, out of the yoke pocket 22 and on the outside of each side of the yoke member 20*a*. The inside, convex surfaces 60*f* and 60*g* of the wear insert 60 are immediately adjacent to and engage the side edges such as 23*d* and 23*f* of the upper yoke member 20*a* in response to stresses applied through butt coupler section butt end 30*e*. The guide posts 54*a* and the wear insert surfaces 60*f* and 60*g* thus engage the edges of the yoke member 20*a* thereby holding the follower block assembly 50 in a substantially transverse position to the longitudinal axis 21 so that the rear surface 50*d* of the follower block assembly squarely meets the cushioning mechanism 52*a* in order to cushion the shock of impact forces and twisting forces transmitted through the coupler 30 to the yoke members 20*a* and 20*b*.

Figure 3:
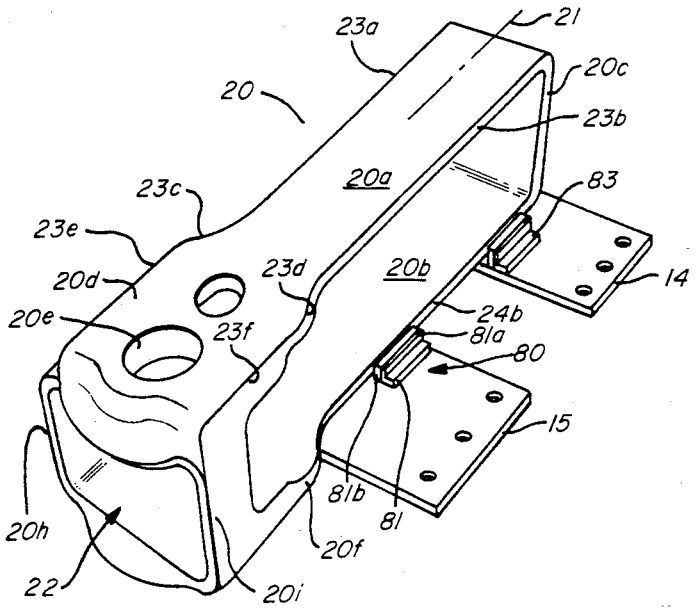
FIG. 3 is a perspective view of the yoke positioner mechanism for maintaining the yoke in a longitudinal position.

The transmission of these external forces through the coupler 30 to the yoke members 20*a* and 20*b* can cause the yoke member to move out of position. To avoid this, this invention includes side guide or yoke positioner assemblies generally designated as 80 in FIG. 3. The yoke positioner assemblies include first and second flange members 81 and 82 mounted onto the yoke strap plate 15 and flange members 83 and 84 mounted onto the yoke strap or wear plate 14. Each of the yoke positioner members 81–84 are identical in structure and thus only one will be described. The first flange member 81 includes an L-shaped metal bracket which may be welded or otherwise attached to the yoke wear plate or strap 15. The L-shaped bracket includes an upwardly extending flange portion 81*a* which may engage the edge 24*b* of the lower yoke member directly. In the alternative, and as a further improvement, a wear pad 81*b* is attached to the inside face of the flange portion 81*a*. The wear pad may also be polyurethane or other non-metallic wear materials of the same type as used for the wear insert 60 of FIG. 5. The wear pad 81 may be held in place by any suitable means and is adapted to engage the side edge 24*b* of the lower yoke member 20*b* to resist movement of the yoke member 20*b* out of its longitudinally aligned position as illustrated in FIGS. 1 and 3.

The combination of the four guide members 81–84 mounted on the yoke wear plates or straps 14 and 15 serve to maintain the lower yoke member 20*b* and thus the entire yoke 20 in a generally longitudinal position and to prevent detrimental movement of the yoke member into positions which may cause wear or other damage to the other portions of the draft cell structure 11.

In summary, the combination of the improved follower block assembly 50 and the yoke position assemblies 80 serve to hold the follower block 50 in a transverse position to improve cushioning and prevent the follower block from losing its shock receiving position. Further, the side guide assemblies 80 serve to hold the yoke member in a generally longitudinal position in order to avoid undesirable movement and thus possible damage to the yoke member or the surrounding draft cell structure.

Having described the invention above, various modifications of the techniques, procedures, material and equipment will be apparent to those in the art. It is intended that all such variations within the scope and spirit of the appended claims be embraced thereby. For example, the principles of this invention apply to other types of railroad cars including but not limited to gondolas, flat cars or any railroad car utilizing a draft system assembly; and, as used in the claims, the term "railroad car" applies to all such cars. Further, this invention car can be practiced on "E" type coupler yoke designs as well as "F" types or other type of coupler systems wherein the follower block can utilize the stabilization principles of this invention.

I claim:

1. A railroad car having an improved draft gear assembly comprising:

a railroad car having a center still structure terminating at one end in a draft center sill section, said draft center sill section including draft center sill side walls, a yoke mounted with said draft center sill section, said yoke including upper and lower yoke members which extend longitudinally of said railroad car and parallel to each other, said upper and lower yoke members being joined at an internal end to form a yoke pocket, said upper and lower yoke members being positioned between said draft center sill side walls;

an interlocking coupler member, said coupler member including a head portion adapted to engage another coupler member on an adjacent railroad car and a shank portion which extends longitudinally into said pocket in said yoke;

a connector assembly mounted with said yoke and extending through said coupler shank in order to mount said coupler shank within said yoke pocket, said coupler shank including a rear butt portion positioned internally of said yoke pocket, said coupler shank being subjected to external forces due to connection of said coupler member head portion to another railroad car coupler member, which external forces translate into pivotal and other transverse stresses in said coupler member shank and said rear butt portion thereof, said connector assembly and in said yoke;

a follower block mounted substantially between said upper and lower yoke members in said yoke pocket in a transverse position between said draft center sill side walls and in engagement with said rear butt portion of said coupler shank to receive external forces transmitted through said coupler member shank;

resilient means mounted in said yoke pocket between said follower block and said internal end of said yoke for receiving and partially absorbing the external forces applied against said coupler member head portion, said coupler shank connector assembly, said coupler rear butt portion and said follower block;

said follower block including a central follower block section located between said upper and lower yoke members for engaging said coupler rear butt portion on one side and said resilient means on the other side of said central section, said follower block further including upper and lower guide portions which are joined to said central follower block section and extend outwardly of said yoke pocket and into engagement with said upper and lower yoke members for maintaining said transverse position of said follower block under the stress of external forces;

said central section of said follower block being generally rectangular including an upper and a lower edge portion;

each of said upper and lower guide portions including tab sections positioned on said upper and lower edge portions and extending outwardly therefrom, said tab sections on said lower edge portion extending downwardly on either side of said lower yoke member and said tab sections on said upper edge portion extending upwardly on either side of said upper yoke member; and said tab sections on each of said upper and lower edge portions being spaced apart to create generally U-shaped areas in which to receive said upper and lower yoke members such that said tab sections engage said upper and lower yoke members thereby maintaining said transverse position of said follower block even under external forces transmitted from said coupler member to said follower block.

2. The structure set forth in claim 1, including:

said follower block central section having a recessed area on one side thereof to receive said rear butt portion of said coupler shank.

3. The structure set forth in claim 1, including:

at least some of said tab sections including wear inserts removably mounted onto said tab sections for direct engagement with said yoke members in order to prevent undue wear to said tab sections or to said yoke members.

4. The structure set forth in claim 1, including:

a yoke positioner assembly mounted onto said draft center sill section of said railroad car on opposite sides of said bottom yoke member in order to engage the opposite sides of said bottom yoke member to minimize transverse movement of said yoke in response to the application of external forces;

said yoke positioner assembly including first and second side flange members mounted onto said draft center sill section and extending upwardly therefrom into engagement with said bottom yoke member to maintain said yoke in its longitudinal position in spite of the application of external forces to said coupler member which are transmitted to said yoke.

5. The structure set forth in claim 4, including:

each of said flange members having a wear pad mounted therewith to actually engage said one yoke member.

6. A follower block assembly adapted to be mounted in the draft gear assembly of a railroad car, which draft gear assembly includes a draft center sill structure, comprising:

a draft gear assembly for a railroad car, said draft gear assembly including a draft center sill structure including first and second draft center sill side walls;

a yoke mounted onto said draft center sill structure, said yoke including upper and lower yoke members which extend longitudinally of a railroad car and parallel to each other with said upper and lower yoke members being joined at an internal end to form a yoke pocket, said upper and lower yoke members being positioned between said draft center sill side walls;

an interlocking coupler member including a head portion adapted to engage another coupler member on an adjacent railroad car and a shank portion which extends longitudinally into said pocket in said yoke;

a connector assembly mounted with said yoke and extending through said coupler shank in order to mount said coupler shank with said yoke pocket, said coupler shank including a rear butt portion positioned internally of said yoke pocket, said coupler shank being subjected to external forces due to connection of said coupler member to another railroad coupler member, which external forces translate into pivotal and other transverse stresses in said coupler member shank and said rear butt portion thereof, said connector assembly and in said yoke;

a follower block assembly mounted substantially between said upper and lower yoke members and in a transverse position between said draft center sill side walls for engaging said coupler butt section on one side of said follower block assembly and a resilient means mounted in said yoke pocket on the other side of said follower block assembly, said follower block assembly including a central section and upper and lower guide portions which are joined to said central section and extend upwardly and downwardly, respectively, from said central section;

said upper and lower guide portions extending upwardly and downwardly, respectively, of said yoke pocket on either side of said yoke members such that said guide portions engage said yoke members when said follower block is subjected to external forces in order to hold said follower block assembly in the transverse position substantially within said yoke pocket to prevent damage to said center sill draft side walls.

7. The structure set forth in claim 6, including:

said upper and lower guide portions cooperate with said central section to form upper and lower U-shaped recesses to receive said first and second yoke members in said recesses.

8. The structure set forth in claim 6, including:

said upper and lower guide portions each include tab members which are joined to said central section and extend upwardly and downwardly from said central section, respectively, in order to engage said upper and lower yoke members when said follower block assembly is subjected to external forces to thereby hold said follower block assembly in engagement with said rear butt portion of said coupler member.

9. The structure set forth in claim 8, including:

said tab members each having a wear insert positioned to engage said yoke members, said tab members having means to removably mount said wear inserts.

10. The structure set forth in claim 9, including:

said means to removably mount each of said tab members includes a mounting groove and each wear insert having a complementary grooved portion to mount said insert onto one of said tab members.

11. The structure set forth in claim 10, including:

said wear inserts for said tab members for said upper guide portions are joined together by a connection portion to form a generally U-shaped wear assembly for mounting onto one of said upper and lower tab member sets.

12. The structure set forth in claim 6, including:

a yoke positioner assembly mounted onto said draft center sill on each side of said lower yoke member and immediately adjacent to the sides of said lower yoke member in order to engage the sides thereof when said lower yoke member is subjected to external forces which would tend to move said yoke member transversely to thereby prevent such movement.

13. The structure set forth in claim 12, including:

said yoke positioner assembly including first and second flanged members mounted onto said draft center sill section, each flanged member including an upwardly extending portion positioned to engage a side of said lower yoke member in order to maintain said lower yoke member in its longitudinal position in response to the application of external forces transmitted through said coupler member.

14. The structure set forth in claim 13, wherein:

each of said flanged members including a wear member mounted onto said upwardly extending portion for direct engagement against the side of said lower yoke member to prevent undue wear to said lower yoke member or to said flanged member.

* * * * *